United States Patent [19]

Moore

[11] Patent Number: 4,863,061

[45] Date of Patent: Sep. 5, 1989

[54] CLOSURE LINER WITH PULL TAB

[75] Inventor: David N. Moore, Plainfield, Ill.

[73] Assignee: Phoenix Closures, Inc., Naperville, Ill.

[21] Appl. No.: 292,937

[22] Filed: Jan. 3, 1989

[51] Int. Cl.[4] ..... B65D 51/00

[52] U.S. Cl. ..... 220/258; 215/232; 215/341

[58] Field of Search ..... 220/258, 255, 256; 215/232, 241, 250, 258

[56] References Cited

U.S. PATENT DOCUMENTS

| | | | |
|---|---|---|---|
| 3,460,701 | 8/1969 | Powalowski et al. | 215/341 |
| 3,900,125 | 8/1975 | Wyler et al. | 220/258 X |
| 3,973,715 | 8/1976 | Johnson et al. | 215/341 X |
| 4,109,815 | 8/1978 | Collins | 215/341 X |
| 4,448,345 | 5/1984 | Helms | 215/232 X |
| 4,596,338 | 6/1986 | Yousif | 215/232 |
| 4,625,875 | 12/1986 | Carr et al. | 215/232 |
| 4,684,554 | 8/1987 | Ou-Yang | 215/341 X |
| 4,697,719 | 10/1987 | Allen | 215/232 |
| 4,747,498 | 5/1988 | Gach | 215/232 |
| 4,747,500 | 5/1988 | Gach et al. | 220/258 X |
| 4,754,890 | 7/1988 | Ullman et al. | 215/232 |
| 4,778,698 | 10/1988 | Ou-Yang | 215/232 X |
| 4,813,578 | 3/1989 | Gordon et al. | 220/258 X |
| 4,815,618 | 3/1989 | Gach | 220/258 X |

*Primary Examiner*—Steven M. Pollard
*Attorney, Agent, or Firm*—Welsh & Katz

[57] ABSTRACT

A closure for use in connection with a capped container includes a seal liner provided with a tab portion, and adapted to seal the mouth of the container, a cap liner adapted to be adhered to the tab portion of the seal liner and releasably retained within the cap so that upon opening of the container as by unscrewing the cap, the cap liner is released from the cap and provides an enlarged gripping surface to enable the consumer to more easily open the container.

10 Claims, 1 Drawing Sheet

CLOSURE LINER WITH PULL TAB

BACKGROUND OF THE INVENTION

The present invention relates to container closures having liners designed to seal open containers, and particularly, to a closure liner arrangement having an enlarged pull tab which facilitates opening of the container.

Aluminum or metallic foil seals are in common use for sealing the mouths of bottles, especially bottles containing consumable products such as pharmaceuticals, food products, etc. In such applications, the foil seal is adhered to the mouth of the bottle subsequent to the filling thereof with the desired consumable product in question. These common seals accomplish two important functions, i.e., they first serve to ensure that no foreign material has entered the bottle after it has been filled with the intended product, and, secondly, they serve to prevent purposeful tampering, because access to the interior of the bottle cannot be achieved without destroying the seal.

These aluminum foil seals are available in a number of forms, including foil coated with polymer, and polymer coated foil laminated to paper. The polymer coating serves to facilitate adherence of the seal to the mouth of the bottle through the application of heat. The bottles most commonly used are plastic bottles, although it is also possible to use a glass bottle with a polymer coated neck end. Such seals are also available which are coated with a special polymer which will even adhere to uncoated glass.

A major problem of conventional seals is that they are extremely difficult for the consumer to remove from the mouth of the bottle. Often there is nothing for the consumer to grab in attempt to remove the seal. Consequently, the consumer usually must use a potentially dangerous sharp tool such as a knife, or merely pokes a finger through the seal. This in turn results in a second problem, i.e., the flexible aluminum seal is not completely removed from the edge of the bottle neck, and is therefore ragged around the opening, making it difficult to remove the product.

Solutions have been proposed, including the formation of gripping tabs along the edge of the seal which project outwardly or vertically beyond the neck of the bottle to facilitate removal of the seal through grasping by the user.

U.S. Pat. No. 4,754,890 discloses a container seal formed from a seal liner having an integral tab portion, the tab being double-folded in a "Z" shape for increased strength and to prevent adherence of the tab to a cap liner. When the container cap is removed, the user unfolds the tab portion to remove the seal. A disadvantage of the seal of the '890 patent is that the tab is still not large enough to facilitate easy opening by consumers.

Thus, there is a need for a container closure liner having a pull tab which is large enough to allow a consumer to grasp and totally remove the seal liner from the container opening. The closure liner should be easy to manufacture and assemble and inexpensive to produce.

SUMMARY OF THE INVENTION

Accordingly, a closure seal liner with a pull tab is provided which is designed to be adhered to a cap liner during the heat sealing of the closure, so that upon removal, the cap liner is retained by the tab and thus provides an enlarged gripping surface for easy removal of the seal liner from the closure. The cap liner may be provided in either solid or ring configuration depending on the application.

DESCRIPTION OF THE PREFERRED EMBODIMENT

Figure 1:
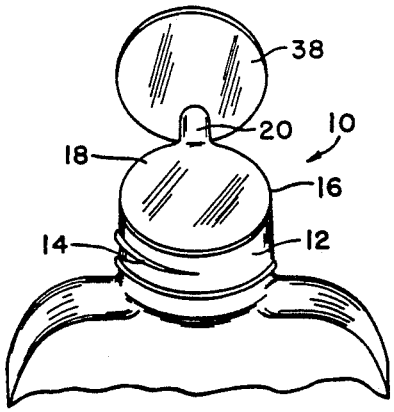
FIG. 1 is a top perspective elevational view showing the closure liner of the invention secured to a container, and having the cap liner adhered to the tab of a seal liner, the cap liner having a solid configuration.
Figure 3:
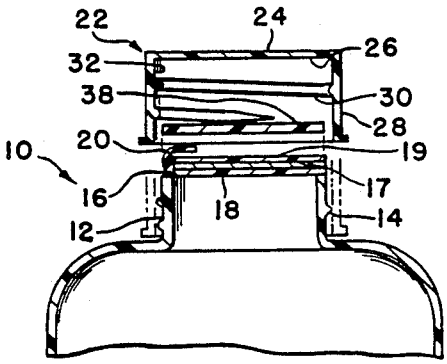
FIG. 3 is an exploded vertical sectional view of the closure of the invention.

Referring now to FIGS. 1 and 3, a glass or plastic container or bottle generally designated 10 is depicted having a narrowed neck portion 12 with external helical threads 14 and an open upper end or mouth 16. The mouth 16 is sealed with a seal liner 18 in accordance with the present invention. The seal liner 18 is a disk preferably fabricated of a metallic foil 17, such as an aluminum foil, which is treated with a polymeric material 19, such as polyethylene or polypropylene. It is preferred that the foil is treated with a material which is identical or similar in chemical makeup to the material used to fabricate the bottle 10, so as to facilitate adhesion between the seal liner 18 and the mouth 16 of the bottle 10. The dimension of the seal liner 18 is such that it extends to and may extend beyond the periphery of the mouth 16 so as to completely close the entire opening thereof.

The seal liner 18 is provided with an integral tab portion 20 which normally projects laterally or vertically outwardly beyond the mouth 16 of the bottle 10.

A cap 22 is also provided and has a top 24 with an underside 26 and a peripherally depending skirt portion 28 which has threads 30 on an interior surface 32 thereof. The cap 22 may be of conventional construction, i.e., either metal or plastic, but preferably is plastic such as polyethylene or polypropylene. A cap liner 38 is provided in a preferably circular shape which will be releasably retained against the cap underside 26. The cap liner 38 is preferably fabricated of plastic such as polyethylene or polypropylene which is compatible with the polymeric treatment of the seal liner 18.

Upon installation, the cap liner 38 is placed against the cap underside 26. The seal liner 18 is then placed within the cap 22 so that the tab portion 20 is folded over and contacts the cap liner 38 (best seen in FIG. 3). The cap 22 is then screwed upon the neck 12 of the bottle 10 with the threads 16 engaging the threads 30, so that the seal liner 18, the tab 20 and the cap liner 38 are pressed against each other. External radiation is applied to the exterior of the cap 22, preferably in the form of heat welding or heat induction sealing, to cause the metallic foil 17 to heat up, thus softening or melting the polymeric treatment 19 of the seal liner 18 so that it adheres to the mouth 16 of the bottle 10, and the polymer of the cap liner 38 to simultaneously adhere to the tab portion 20. The radiation is applied in such a manner, and the cap liner 38 is of such a polymeric composition, so that the cap liner 38 does not adhere to the underside 26 of the cap 22. Thus, subsequent to the application of radiation, the seal liner 18 is sealed to the mouth 16 of the bottle 10 and the tab portion 20 is sealed to the cap liner 38; however, the cap liner is still releasably retained within the cap 22.

The bottle 10 is opened in conventional fashion by unscrewing the cap 22 from the threaded neck 12 of the bottle 10. As the cap 22 is unscrewed, the cap liner 38 becomes detached therefrom, and the cap liner 38, secured to the tab portion 20, provides an enlarged gripping surface to enable the consumer to more easily remove the seal liner 18.

Figure 2:
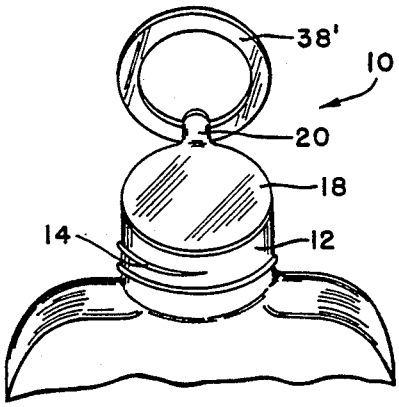
FIG. 2 is a top perspective elevational view as shown in FIG. 1, with the cap liner which is adhered to the tab portion of the seal liner having a ring configuration.

Referring now to FIGS. 1 and 2, depending on the application, the cap liner 38 may be fabricated as a solid disc (best shown in FIG. 1), or an annular ring 38' (best shown in FIG. 2), the latter configured to allow the insertion of a finger for pulling action.

Figure 3A:
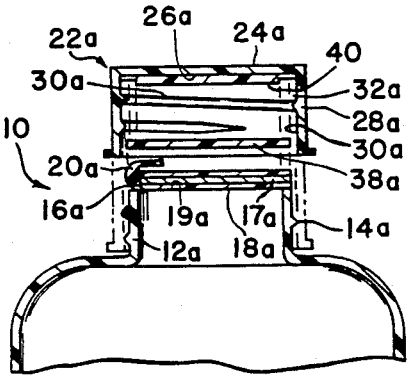
FIG. 3A is an exploded vertical sectional view of an alternative embodiment of the closure of the invention.

Referring now to FIG. 4, an alternate embodiment of the invention is depicted for use in applications where the bottle 10 is to be resealed. Since many of the components in the alternate embodiment are identical to those in the embodiment of FIG. 3, they are referred to by the same reference numerals, and are distinguished by a small 'a'. In the embodiment of FIG. 3A, an additional cap liner 40 is provided which is permanently secured to the underside 26*a* of the cap 22*a*. The additional cap liner 40 is preferably made of similar polymers as is the liner 38. Once the seal liner 18*a* and the cap liner 38*a* are removed from the bottle 10, the cap 22*a* with the additional cap liner 40 may be retained upon the bottle 10 to seal the mouth 16*a*.

Thus, the invention provides a closure liner with pull tab which is easier for consumers to open than conventional liners, completely removes the seal liner, and is inexpensive to produce.

While a particular embodiment of the closure liner with pull tab of the invention has been shown and described, it will be appreciated by those skilled in the art that changes and modifications may be made thereto without departing from the invention in its broader aspects and as set forth in the following claims.

I claim:

1. A closure for use in connection with a container having a neck portion and a mouth, comprising:

a closure cap including a top portion having an underside and a depending peripheral skirt;

a cap liner configured to be releasably retained within said cap;

a seal liner adapted to be sealed to said mouth, said liner having a tab portion; and said tab portion being constructed and arranged to be attached to said cap liner concurrently with the sealing of said seal liner to said mouth, so that as said cap is detached from said container, said cap liner is retained by said seal liner.

2. The closure a defined in claim 1 wherein said seal liner is fabricated of metallic foil treated with a heat deformable plastic material.

3. The closure as defined in claim 2 wherein said plastic is polyethylene.

4. The closure as defined in claim 2 wherein said plastic is polypropylene.

5. The closure as defined in claim 1 wherein said tab portion is solid.

6. The closure as defined in claim 1 wherein said tab portion has an annular ring configuration.

7. The closure as defined in claim 1 further including an additional cap liner fixed to said cap underside.

8. A closure for a container having a neck portion with a mouth and a cap portion having a skirt portion, said closure comprising:

a seal liner fabricated of treated foil, being adapted to be sealed to said mouth, and having a tab portion;

a cap liner adapted to be adhered to said tab portion by externally applied radiation while the cap portion is secured on said container, the radiation also sealing said seal liner to said mouth, said cap liner being retained by said tab portion when said cap portion is removed from said neck portion.

9. The liner as defined in claim 7 wherein said cap liner is adhered to said tab portion by heat welding.

10. A method of sealing a container, comprising:

providing a container with a neck portion, a mouth and a closure cap;

releasably inserting a cap liner within said cap;

placing a seal liner in said cap, said liner having a tab portion disposed to contact said cap liner;

threading said cap upon said neck so that said seal liner covers said mouth;

applying radiation to said closure cap so that said seal liner is sealed to said mouth and said tab portion adheres to said cap liner.

* * * * *